US008159125B2

(12) United States Patent
Miao

(10) Patent No.: US 8,159,125 B2
(45) Date of Patent: Apr. 17, 2012

(54) COLOR TEMPERATURE ADJUSTABLE LAMP

(76) Inventor: Cheng-Hsi Miao, Taipei (TW)

( * ) Notice: Subject to any disclaimer, the term of this patent is extended or adjusted under 35 U.S.C. 154(b) by 170 days.

(21) Appl. No.: 12/467,571

(22) Filed: May 18, 2009

(65) Prior Publication Data

US 2010/0264795 A1 Oct. 21, 2010

(30) Foreign Application Priority Data

Apr. 21, 2009 (TW) ..... 98113205 A

(51) Int. Cl.
*H01J 1/62* (2006.01)

(52) U.S. Cl. ..... 313/498; 313/512

(58) Field of Classification Search ..... 313/498, 313/512

See application file for complete search history.

(56) References Cited

U.S. PATENT DOCUMENTS 7,329,904 B2 * 2/2008 Nawashiro et al. ..... 257/98
7,350,936 B2 * 4/2008 Ducharme et al. ..... 362/231
2007/0258240 A1 * 11/2007 Ducharme et al. ..... 362/231

FOREIGN PATENT DOCUMENTS

JP 2007265818 A * 10/2007

* cited by examiner

*Primary Examiner* — Vip Patel
(74) *Attorney, Agent, or Firm* — Lowe Hauptman Ham & Berner LLP

(57) ABSTRACT

A color temperature adjustable lamp is created through mixture of the color temperature of a low color temperature white LED and a high color temperature white LED. A plurality of different color temperatures in between the color temperature of the low color temperature white LED and the color temperature of the high color temperature white LED can be created to emit. The color temperature is also known as Correlated Color Temperature (CCT).

19 Claims, 2 Drawing Sheets

COLOR TEMPERATURE ADJUSTABLE LAMP

RELATED APPLICATIONS

The present application is based on, and claims priority from, Taiwanese Application Number 098113205, filed Apr. 21, 2009, the disclosure of which is hereby incorporated by reference herein in its entirety.

FIELD OF THE INVENTION

This invention relates to a color temperature adjustable lamp, especially to a lamp to which the color temperature is adjusted by controlling the currents of a low color temperature white LED and a high color temperature white LED.

BACKGROUND

FIG. 1 is a prior art. It is well known that color can have a profound effect on how we feel both mentally and physically. The ancient Egyptians as well as the Native American Indians used color and colored light to heal. Blue color represents peace; Green color represents nature; Purple color represents royalty; and Yellow color represents happiness . . . etc., that is to say, different color temperature creates different atmosphere. In other words, people may like to have white light with a bit of yellow at one time, but may like to have white with a bit of blue at another time. A prior art of a color temperature adjustable lamp is shown in FIG. 1, a red (R) light emitted diode (LED), a green (G) light emitted diode, and a blue (B) light emitted diode are mounted on a substrate 10 to be adjusted for producing a desired color temperature to emit. Glue 15 encloses the three LEDs R, G, and B as a protection. The red LED electrically couples to a common electrode 124 and a first electrode lead 121. The green LED electrically couples to the common electrode 124 and a second electrode lead 122. The blue LED electrically couples to the common electrode 124 and a third electrode lead 123. The traditional color temperature adjustable lamp needs to control currents of three diodes R, G; and B to obtain desired color temperature atmosphere. To adjust three current variable components is a little complicated to an end user. It is desired to develop a color temperature adjustable lamp with lesser adjustable variable components.

DETAILED DESCRIPTION OF EMBODIMENTS

Figure 1:
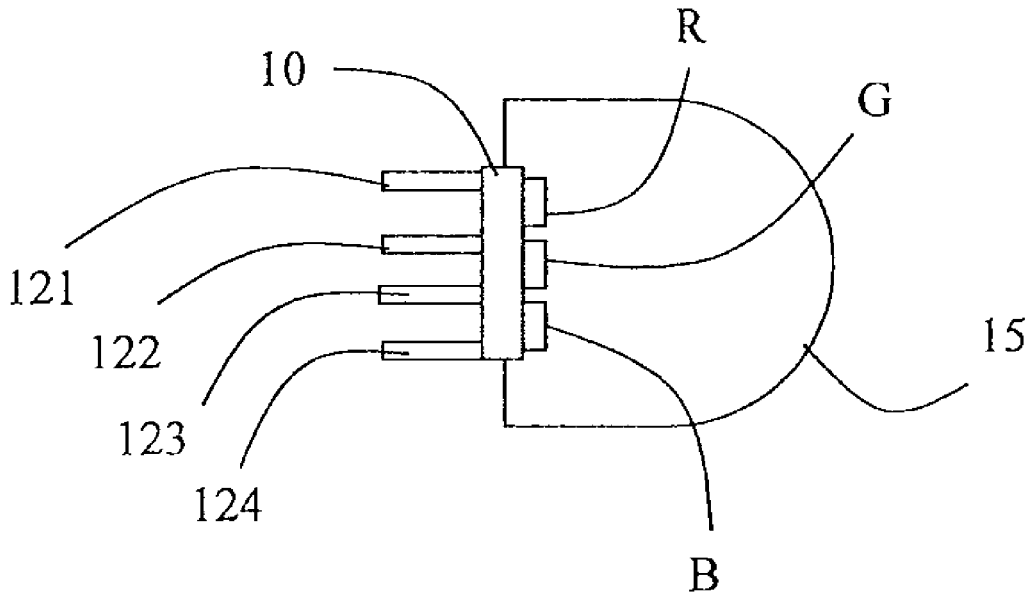
Fig. 1 Prior Art
FIG. 1 is a Prior Art
Figures 2A, 2B:
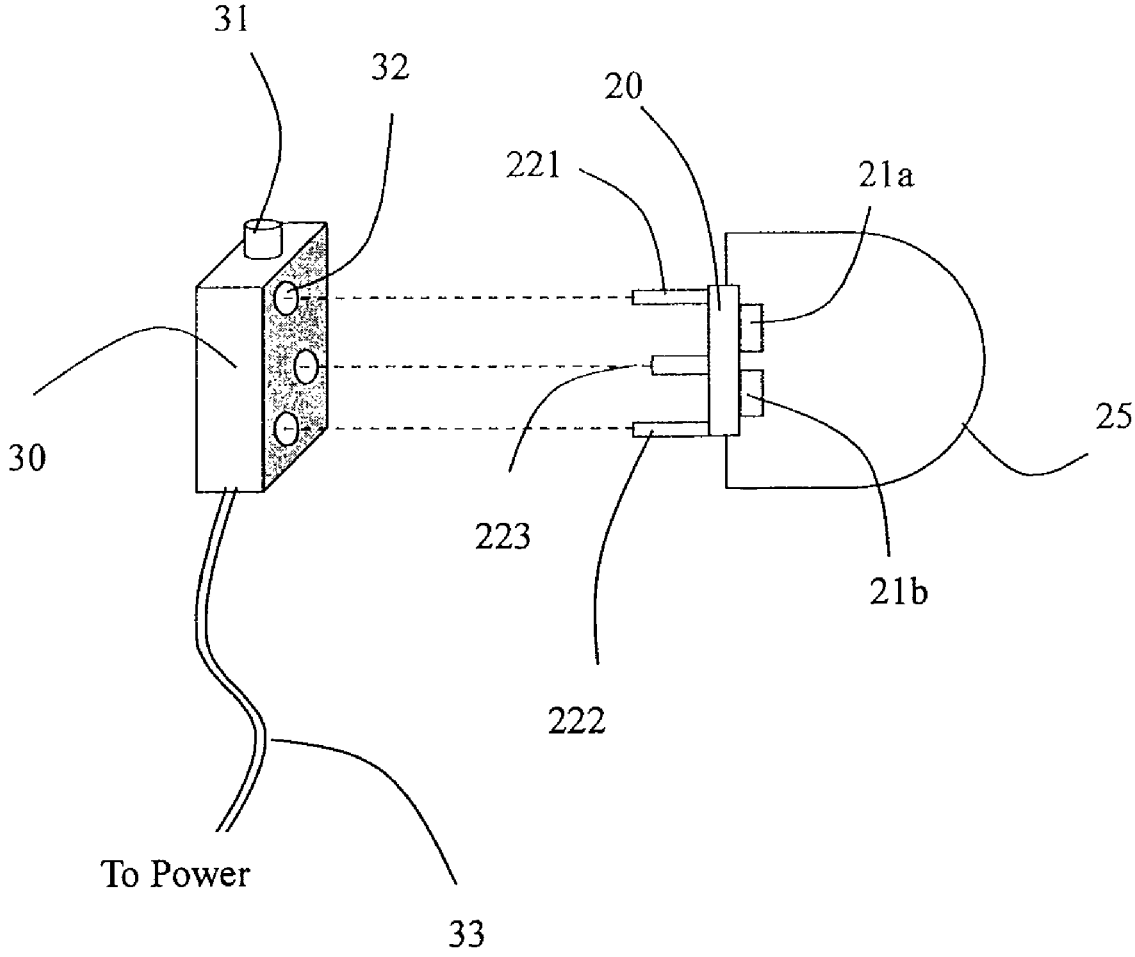
FIG. 2 is an embodiment according to the present invention.

FIG. 2 is an embodiment according to the present invention. A low color temperature white light emitted diode (LED) 21*a* and a high color temperature white light emitted diode (LED) 21*b* are mounted on a substrate 20 which can be a circuit board or a lead frame to be adjusted for producing a desired color temperature to emit.

Glue or a glass lamp shade 25 encloses the white light emitted diodes 21*a*, 21*b* as a protection. The low color temperature white LED 21*a* electrically couples to a common electrode lead 223 and a first electrode lead 221. The high color temperature white LED 21*b* electrically couples to the common electrode lead 223 and a second electrode lead 222. A control unit 30 controls the light intensity of the white LEDs 21*a* and 21*b*, which has three mounting holes 32 with electrical contacts inside (not shown) each electrically coupling to one of the electrode leads 221, 222, and 223 when the three electrode leads 221, 222, and 223 are inserted into the holes 32. A power cord 33 electrically couples the control unit 30 to a power (not shown). A turning knob 31 for user to adjust the currents of the low color temperature LED 21*a* and the high color temperature LED 21*b* to produce different color temperature for the lamp to emit.

TABLE I color temperature vs. color display

| Color temperature (K.) | Color display |
|---|---|
| 2500 K.~4000 K. | White (colorless) light with a bit of yellow-red light. |
| 4000 K.~5500 K. | White (colorless) light with a bit of blue light |
| 5500 K.~7000 K. | White (colorless) light with a bit of gray light |
| 7000 K.~8000 K. | White (colorless) light with a bit of green light |

Table 1 shows a relationship between color temperatures vs. color display. While under low color temperature (2500K~4000K), it appears white (colorless) light with a bit of yellow-red light. While under middle low color temperature (4000K~5500K), it appears white (colorless) light with a bit of blue light. While under middle high color temperature (5500K~7000K), it appears white (colorless) light with a bit of gray light. While under high color temperature (7000K~800K), it appears white with a bit of green.

TABLE II

Mixture of Color Temperatures

| Color Temperatures | Components Percentage of Mixture | | | | | |
|---|---|---|---|---|---|---|
| 2500 K. | 0% | 20% | 40% | 60% | 80% | 100% |
| 6000 K. | 100% | 80% | 60% | 40% | 20% | 0% |
| Mixed Color temperatures | 6000 K. | 5300 K. | 4600 K. | 3900 K. | 3200 K. | 2500 K. |

Table II shows an example of mixture of a low color temperature of 2500K and a high color temperature of 6000K. The resulted color temperatures are calculated by weighted average and shown respectively in the bottom row: with 6000K, 5300K, 4600K, 3900K, 3200K, and 2500K respectively when the low color temperature of 2500K contributes 0%, 20%, 40%, 60%, 80%, and 100% and 6000 k contributes complementary 100%, 80%, 60%, 40%, 20% and 0% each in the combinations. The calculation of mixed color temperatures are listed as follows:

$$2500K*0\%+6000K*100\%=6000K$$

$$2500K*20\%+6000K*80\%=5300K$$

$$2500K*40\%+6000K*60\%=4600K$$

$$2500K*60\%+6000K*40\%=3900K$$

$$2500K*80\%+6000K*20\%=3200K$$

$$2500K*100\%+6000K*0\%=2500K$$

The above calculation is based on linear relationship of color temperatures for white LEDs, however in actual situation; the color temperature is not ideally linear for a white LED. The actual color temperatures displayed for a product may have somewhat deviation from the value calculated as above.

While several embodiments have been described by way of example, it will be apparent to those skilled in the art that various modifications may be made without departing from the spirit of the present invention. Such modifications are all within the scope of the present invention, as defined by the appended claims.

What is claimed is:

1. A color temperature adjustable lamp, comprising:

a low color temperature white LED;

a high color temperature white LED; and a control unit, controlling light intensities of the LEDs to produce mixed white light having a color temperature determined in accordance with the following equation:

$$K=K_{low}*P_{low}+K_{high}*P_{high},$$

where

K is the color temperature of the mixed white light, $K_{low}$ is a color temperature of the low color temperature white LED, $K_{high}$ is a color temperature of the high color temperature white LED, $P_{low}$ is a percentage of light emitted by the low color temperature white LED in the mixed white light, and $P_{high}$ is a percentage of light emitted by the high color temperature white LED in the mixed white light.

2. A color temperature adjustable lamp as claimed in claim 1, further comprising a substrate, to which said LEDs are mounted, said substrate being separate from the control unit.

3. A color temperature adjustable lamp as claimed in claim 2, wherein said substrate is a circuit board or a lead frame.

4. A color temperature adjustable lamp as claimed in claim 1, further comprising a protection unit to enclose said LEDs.

5. A color temperature adjustable lamp as claimed in claim 4, wherein said protection unit is glue or a glass lamp shade.

6. A color temperature adjustable lamp as claimed in claim 1, further comprising:

three electrode leads respectively electrically coupling to said LEDs.

7. A color temperature adjustable lamp as claimed in claim 1, wherein said control unit controls currents of said LEDs.

8. A color temperature adjustable lamp as claimed in claim 1, wherein the color temperature of said low color temperature white LED is 2500K~3500K.

9. A color temperature adjustable lamp as claimed in claim 1, wherein the color temperature of said high color temperature white LED is 5000K~6000K.

10. The color temperature adjustable lamp as claimed in claim 1, wherein $P_{low}+P_{high}=100\%$.

11. A color temperature adjustable lamp, comprising:

a substrate having opposite first and second surfaces, a first white light emitting diode (LED) mounted on the first surface of said substrate and emitting first white light having a first color temperature;

a second white LED mounted on the first surface of said substrate and emitting second white light having a second color temperature higher than the first color temperature;

a plurality of electrode leads electrically coupled to the LEDs, respectively, and projecting from the second surface of the substrate; and a control unit for controlling light intensities of the LEDs to produce mixed white light having a color temperature determined in accordance with the following equation:

$$K=K_{low}*P_{low}+K_{high}*P_{high},$$

where

K is the color temperature of the mixed white light, $K_{low}$ is the first color temperature of the first white LED, $K_{high}$ is the second color temperature of the second white LED, $P_{low}$ is a percentage of light emitted by the first white LED in the mixed white light, and $P_{high}$ is a percentage of light emitted by the second white LED in the mixed white light;

wherein said control unit has mounting holes each for receiving one of the electrode leads therein, said mounting holes having electrical contacts for electrical connection with the respective electrode leads to enable said control unit to control currents of the LEDs to whereby control the light intensities of the LEDs.

12. The color temperature adjustable lamp as claimed in claim 11, wherein the control unit further includes a user operable controlling element to enable a user to adjust the currents of the LEDs for changing the color temperature of the mixed white light emitted by the lamp.

13. The color temperature adjustable lamp as claimed in claim 12, wherein the control unit varies the light intensities of the LEDs to change the color temperature of the mixed white light emitted by the lamp in accordance with a table which includes:

a first series of first values of the percentage of the light emitted by the first white LED in the mixed white light, a second series of second values of the percentage of the light emitted by the second white LED in the mixed white light, and a third series of third values of the color temperature of the mixed white light, wherein each of the third values corresponds to a respective one of the first values and a respective one of the second values.

14. The color temperature adjustable lamp as claimed in claim 13, wherein, in said table, a sum of any of the first values and the corresponding second value is 100%.

15. The color temperature adjustable lamp as claimed in claim 11, wherein the electrode leads are removable from the respective mounting holes.

16. The color temperature adjustable lamp as claimed in claim 11, wherein the first color temperature of said first white LED is 2500K~3500K.

17. The color temperature adjustable lamp as claimed in claim 16, wherein the second color temperature of said second white LED is 5000K~6000K.

18. The color temperature adjustable lamp as claimed in claim 17, further comprising:

a common transparent cover enclosing both said LEDs therein, wherein said common transparent cover covers the first surface of said substrate without covering the second surface of said substrate.

19. The color temperature adjustable lamp as claimed in claim 11, wherein $P_{low}+P_{high}=100\%$.

* * * * *